US007281592B2

(12) United States Patent
Runia et al.

(10) Patent No.: US 7,281,592 B2
(45) Date of Patent: Oct. 16, 2007

(54) INJECTING A FLUID INTO A BOREHOLE AHEAD OF THE BIT

(75) Inventors: Douwe Johannes Runia, Rijswijk (NL); David George Livesey Smith, Rijswijk (NL); Robert Nicholas Worrall, Rijswijk (NL)

(73) Assignee: Shell Oil Company, Houston, TX (US)

( * ) Notice: Subject to any disclaimer, the term of this patent is extended or adjusted under 35 U.S.C. 154(b) by 286 days.

(21) Appl. No.: 10/484,547

(22) PCT Filed: Jul. 23, 2002

(86) PCT No.: PCT/EP02/08206

§ 371 (c)(1),
(2), (4) Date: Jul. 8, 2004

(87) PCT Pub. No.: WO03/010410

PCT Pub. Date: Feb. 6, 2003

(65) Prior Publication Data

US 2004/0238218 A1 Dec. 2, 2004

(30) Foreign Application Priority Data

Jul. 23, 2001 (EP) ..... 01306310

(51) Int. Cl.
*E21B 10/60* (2006.01)
*E21B 10/62* (2006.01)
*E21B 21/10* (2006.01)

(52) U.S. Cl. ..... 175/57; 175/318; 175/324; 175/393

(58) Field of Classification Search ..... None
See application file for complete search history.

(56) References Cited

U.S. PATENT DOCUMENTS

| | | | | |
|---|---|---|---|---|
| 2,169,223 | A | 8/1939 | Christian | 255/61 |
| 2,179,010 | A | 11/1939 | Creighton et al. | 255/72 |
| 2,284,580 | A | 5/1942 | Kammerer | 255/61 |
| 3,052,838 | A | 9/1962 | Bennett et al. | 324/10 |
| 3,112,442 | A | 11/1963 | Bennett | 324/1 |

(Continued)

FOREIGN PATENT DOCUMENTS

DE 19813087 9/1999

(Continued)

OTHER PUBLICATIONS

International Search Report dated Nov. 19, 2002.

*Primary Examiner*—Zakiya W. Bates

(57) ABSTRACT

A method and system for introducing a fluid into a borehole, in which there is arranged a tubular drill string including a drill bit, wherein the drill bit is provided with a passageway between the interior of the drill string and the borehole, and with a removable closure element for selectively closing the passageway in a closing position, and wherein there is further provided a fluid injection tool comprising a tool inlet and a tool outlet, the method comprising passing the fluid injection tool through the drill string to the closure element, and using it to remove the closure element from the closing position, passing the fluid injection tool outlet through the passageway, and introducing the fluid into the borehole from the interior of the drill string through fluid injection tool into the borehole.

19 Claims, 3 Drawing Sheets

U.S. PATENT DOCUMENTS

| | | | | |
|---|---|---|---|---|
| 3,429,387 | A | 2/1969 | Brown | |
| 3,488,765 | A | 1/1970 | Anderson | |
| 3,700,049 | A | 10/1972 | Tiraspolsky et al. | 175/50 |
| 4,484,628 | A | 11/1984 | Lanmon, II | 166/250 |
| 4,597,440 | A | 7/1986 | Pottier | 166/250 |
| 4,715,446 | A | 12/1987 | Wittrisch | 166/381 |
| 4,807,717 | A | 2/1989 | Winters et al. | 181/102 |
| 4,877,089 | A | 10/1989 | Burns | 166/377 |
| 4,932,005 | A | 6/1990 | Birdwell | 367/83 |
| 4,945,987 | A | 8/1990 | Wittrisch | 166/250 |
| 5,244,050 | A | 9/1993 | Estes | 175/393 |
| 5,265,680 | A | 11/1993 | Withers et al. | 166/380 |
| 5,318,125 | A | 6/1994 | Wittrisch | 166/277 |
| 5,433,276 | A | 7/1995 | Martain et al. | 166/384 |
| 5,447,197 | A | 9/1995 | Rae | |
| 5,547,506 | A | 8/1996 | Rae | |
| 5,589,825 | A | 12/1996 | Pomerleau | 340/854.9 |
| 5,636,686 | A | 6/1997 | Wittrisch | 166/66 |
| 5,941,322 | A | 8/1999 | Stephenson et al. | |
| 6,119,777 | A | 9/2000 | Runia | 166/254.2 |

FOREIGN PATENT DOCUMENTS

| | | |
|---|---|---|
| EP | 1115961 | 3/2003 |
| FR | 2628129 | 9/1989 |
| GB | 2069397 | 8/1981 |
| GB | 2146126 | 4/1985 |
| GB | 2166993 | 5/1986 |
| WO | 00/17488 | 3/2000 |

INJECTING A FLUID INTO A BOREHOLE AHEAD OF THE BIT

FIELD OF THE INVENTION

The present invention relates to a method and system for introducing a fluid into a borehole formed in an underground earth formation. The term fluid is used in the specification and in the claims to refer to any material that can be pumped through a tubular drill string, for example cement, lost circulation material, or cleaning fluid. The fluid can also include solid particles.

BACKGROUND OF THE INVENTION

Lost circulation material is any material, which can be used to block fractures in underground formations and is generally of a coarser nature.

SUMMARY OF THE INVENTION

The invention relates in particular to introducing such a fluid into the borehole ahead of the drill bit at the lower end of the drill string.

In the course of a drilling operation, in particular when drilling an oil or gas well, it is on occasion desirable to pump a fluid into the borehole. For example, when drilling into a fractured or porous zone, it is desired to cure losses and to maintain formation strength by using cement and/or lost circulation material. Another example is setting a cement plug for abandonment of a well or well section, possibly followed by drilling of a branched well section.

It is considered highly undesirable to attempt pumping of a fluid of high density or viscosity and/or comprising coarse material through the drill string with a drill bit attached. Conventional drill bits such as polycrystalline diamond cutter (PDC) bits or roller cone bits are provided with bit nozzles. However, the fluid would need to be forced through the bit nozzles, and there is a high risk for the nozzles to plug up due to the high shear, rapid pressure drop, and small orifice. Nozzles normally comprise a nozzle channel with a nozzle insert, and the orifice could in principle be increased by removing the nozzle inserts from the bit. This option is however not seriously contemplated in practice since it would significantly impair the performance of the bit for progressing into the formation.

Therefore, in practice the drill bit is removed from the drill string and is replaced by a tool with a sufficiently large orifice in order that fluid can be introduced. To this end the drill string needs to be pulled out of the borehole. In order that the drill string can be pulled, it is often required to first temporarily stabilize the borehole by introducing lost circulation material. This can be done through ports in the lower part if the drill string above the drill bit that can be opened and closed again, for example arranged in a so-called circulating sub. Introducing lost circulation material via this route above the bit can plug the annulus between borehole wall and the lower part of the drill string including the drill bit, thereby requiring removal of the drill string and further complicating operations. The pumping of cement through the same ports is not a practical option, since there is a significant risk that the lower part of the drill string including the drill bit will be cemented in place.

When the drill string then has been fully pulled up, the drill bit is for example replaced by a cementing stinger, and the drill string is lowered again in the borehole to the desired depth, whereupon fluid can be introduced into the borehole.

If it is then desired to resume drilling, the drill string needs to be pulled out of the borehole hole a second time, so that the drill bit can be mounted again.

This procedure is time-consuming and therefore uneconomic. Moreover, introducing a fluid such as cement is often needed in a situation where the borehole is unstable, and in such situation it can be undesirable to pull the drill string out of the borehole.

It is an object of the present invention to provide a method for introducing a fluid into a borehole, wherein fluid can be safely introduced through the drill string with a drill bit attached at its lower end.

It is a further object to provide a system for introducing a fluid into a borehole which system allows to drill and to introduce fluid into the borehole without the need to replace the drill bit.

To this end there is provided a method for introducing a fluid into a borehole formed in an underground earth formation, in which borehole there is arranged a tubular drill string including a drill bit at its lower end, wherein the drill bit is provided with a passageway between the interior of the drill string above the drill bit and the borehole exterior of the drill bit, and with a removable closure element for selectively closing the passageway in a closing position, and wherein there is further provided a fluid injection tool comprising a tool inlet, and a tool outlet in fluid communication with the tool inlet, which method comprises the steps of:

- passing the fluid injection tool from a position interior of the drill string to the closure element, and using the fluid injection tool to remove the closure element from the closing position;
- passing the fluid injection tool to a landing position where the tool outlet has passed through the passageway and where the tool inlet resides inside the drill string in fluid communication with the interior of the drill string; and;
- introducing the fluid from the interior of the drill string into the borehole, wherein the fluid is received by the tool inlet and introduced into the borehole through the tool outlet.

The invention is based on the insight, that a drill bit having a sufficiently large passageway can, except for drilling, also be used for lowering a fluid injection tool into the borehole ahead of the drilling bit, in order to introduce a fluid into the borehole. In order that the drill bit can be efficiently used for both operations, the passageway is provided with a closure element that can be selectively removed from the closing position by using the fluid injection tool from the inside of the drill string.

During normal drilling operation, drilling fluid is normally ejected from inside the drill string via nozzles provided in the drill bit. With the passageway open it would not be possible to create the high-speed jets of drilling fluid through the nozzles, that are needed to carry the drill cuttings away from the drill bit and aid in formation penetration. Therefore, the closure element is in the closing position for normal drilling operation, and preferably the closure element is provided with cutting elements that form a joint bit face with the cutting elements on the drill bit during drilling operation.

For introducing fluid into the borehole, the fluid injection tool is lowered through the drill string into the drill bit to the closure element, in order to remove the closure element from the closing position. This is preferably done by connecting the fluid injection tool to the closure element. The outlet of the fluid injection tool can then be passed through the passageway into the borehole ahead of the drill bit, whereas the tool inlet remains in and in fluid communication with the interior of the drill string. In this position, which is referred to as landing position, fluid communication is provided between the interior of the drill string and the borehole exterior of the drill bit via the passageway. The length of the fluid injection tool and the shape of the tool outlet can be designed according to the specific application, such as introducing a cement, lost circulation material, or a cleaning fluid.

It will be clear that a drill bit nozzle is not considered a passageway. Preferably, the smallest cross-sectional area along the passageway is at least 5 $cm^2$, more preferably the passageway is arranged so as to allow a conduit, e.g. a fluid injection tool, of about 2.5 cm (1 inch) diameter to pass through the passageway.

U.S. patent publication No. 2,169,223 discloses a reamer bit of the fish-tail type, provided with a central longitudinal passageway. During normal operation the reamer bit is used to increase the diameter of an existing borehole, the so-called rat hole. For the reaming operation the passageway is closed from inside the drill string by means of a plug, which can be retrieved to surface by wireline. Thereafter a flushing apparatus may be lowered for flushing out the rat hole.

German patent application publication No. DE 198 13 087 A1 discloses a system for rotary and hammer drilling and for injection drilling. The known system comprises concentrical and decoupled outer and inner drill strings, which form a drill bit at the end. The inner drill string is provided with injection nozzles along its length, and can be slid out of the outer drill string for high-pressure injection drilling, eventually followed by cementing.

A drill bit having a passageway and a removable closure element is disclosed in the International Patent Application with publication number WO 00/17488.

There is further provided a system for drilling and for introducing a fluid into a borehole in an underground earth formation, which system comprises:

- a tubular drill string having a drill bit at its lower end, wherein the drill bit is provided with a passageway between the interior of the drill string above the drill bit and the borehole exterior of the drill bit, and with a removable closure element for selectively closing the passageway in a closing position; and
- a fluid injection tool comprising a tool inlet and a tool outlet in fluid communication with the tool inlet, which fluid injection tool is arranged so that it can pass from a position interior of the drill string to a landing position where the tool outlet has passed through the passageway and where the tool inlet resides inside the drill string in fluid communication with the interior of the drill string, and wherein the fluid injection tool is provided with means for removing the closure element from the closing position.

The means for removing the closure element from the closing position suitably comprises a connection means for selectively connecting the fluid injection tool from inside the drill string to the closure element in the closing position.

The fluid injection tool serves to guide the fluid from the passageway to the position in the borehole where the fluid is to be introduced. Depending on the type of fluid to be introduced, the fluid injection tool and particularly the tool outlet can appropriately be designed.

If the fluid is cement or lost circulation material, the fluid injection tool suitably has the form of a cementing stinger, which can be for example up to 100 m long, or more. If the fluid is lost circulation material, the tool can be much shorter, for example 10-20 m. Examples of lost circulation material include cellophane flakes, walnut hulls, ground calcium carbonate. When a salt saturated drilling mud is present in the borehole, even salt can be used.

The fluid injection tool can in particular have telescopic form, allowing to increase the length during operation. The telescopic form can be less robust than a conventional stinger, however this form is possible since the tool is designed to be deployed within the drill string, wherein it is better protected than a conventional stinger when lowered into a borehole.

The fluid can also be a cleaning fluid. The cleaning fluid can for example be water or brine, but can also comprise acid (e.g. 5% hydrochloric acid or acetic acid), finely suspended particles (e.g. calcium carbonate, hematite), polymers or other chemical agents, mixed with water and/or oil. A cleaning fluid can for example be used to remove mudcake from the borehole wall, or to clean the face of the drill bit. In that event the tool outlet has the form of jetting nozzles which are oriented in the desired direction, or possibly rotatably arranged.

Suitably, the fluid injection tool is further provided with a landing member, which is arranged so as to close the passage through the bit nozzles when the fluid injection tool is in the landing position. The landing member therefore prevents that the bit nozzles become plugged when the fluid is introduced from the drill string via the passageway and the fluid injection tool into the borehole.

BRIEF DESCRIPTION OF THE DRAWINGS

The invention will now be described in more detail and with reference to the drawings, wherein.

DETAILED DESCRIPTION OF THE INVENTION

Figure 1:
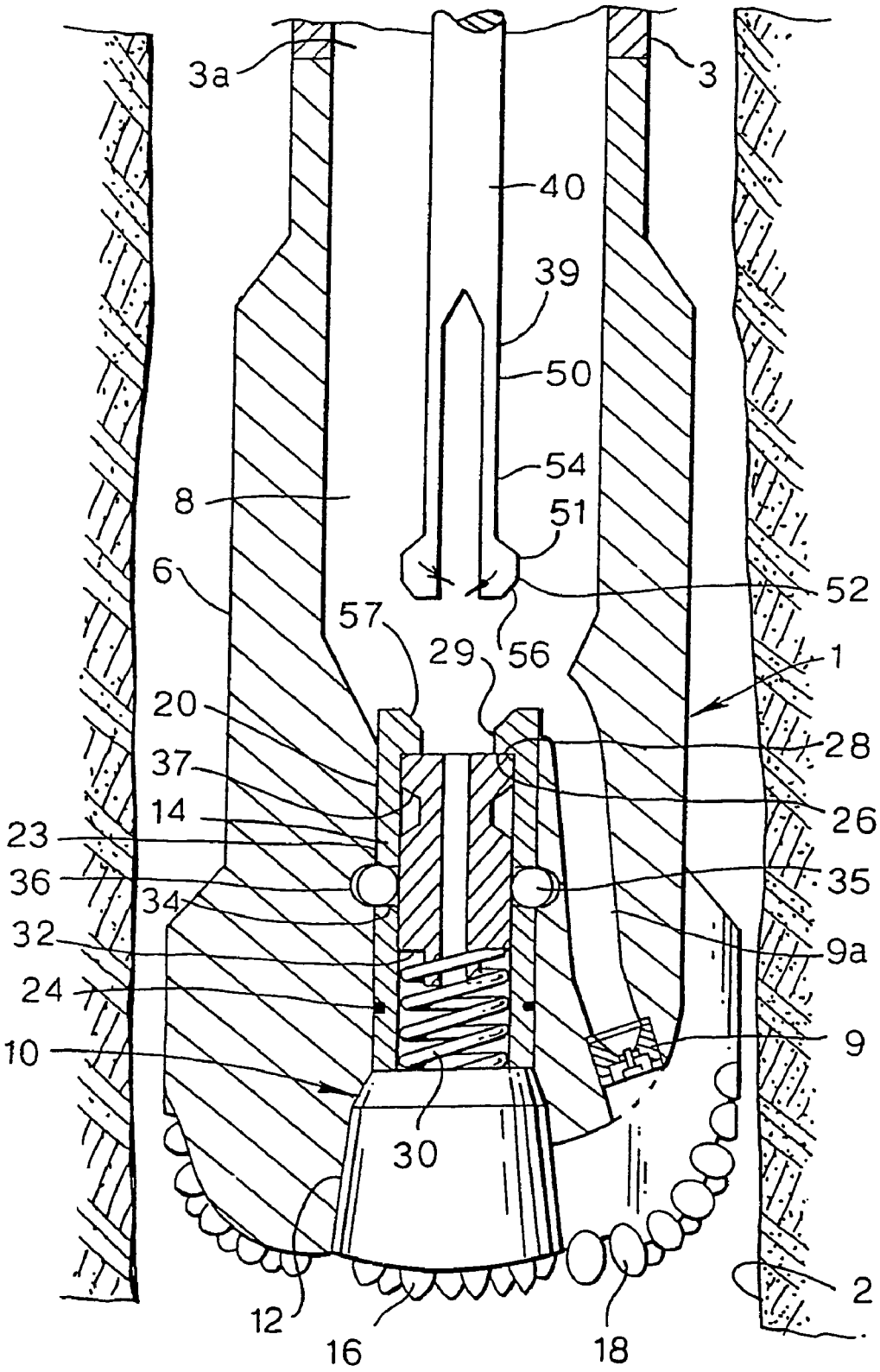
FIG. 1 shows schematically a drill bit for use with the present invention.

With reference to FIG. 1, basic features of the present invention will now be discussed. FIG. 1 shows schematically a longitudinal cross-section of a rotary drill bit 1, which is a suitable embodiment for use with the present invention. The drill bit 1 is shown in the borehole 2, and is attached to the lower end of a drill string 3 at the upper end of the bit body 6. The bit body 6 of the drill bit 1 has a central longitudinal passageway 8 providing fluid communication, and in particular passage for a tool, between the interior 3*a* of the drill string 3 and the borehole 2 exterior of the drill bit 1, as will be pointed out in more detail below. Bit nozzles are arranged in the bit body 6. Only one nozzle with insert 9 is shown for the sake of clarity. The nozzle 9 is connected to the passageway 8 via the nozzle channel 9*a*.

The drill bit 1 is further provided with a removable closure element 10, which is shown in FIG. 1 in its closing position with respect to the passageway 8. The closure element 10 of this example includes a central insert section 12 and a latching section 14. The insert section 12 is provided with cutting elements 16 at its front end, wherein the cutting elements are arranged so as to form, in the closing position, a joint bit face together with the cutters 18 at the front end of the bit body 6. The insert section can also be provided with nozzles (not shown). Further, the insert section and the cooperating surface of the bit body 6 are shaped suitably so as to allow transmission of drilling torque from the drill string 3 and bit body 6 to the insert section 12.

The latching section 14, which is fixedly attached to the rear end of the insert section 12, has substantially cylindrical shape and extends into a central longitudinal bore 20 in the bit body 6 with narrow clearance. The bore 20 forms part of the passageway 8, it also provides fluid communication to nozzles in the insert section 12.

Via the latching section 14 the closure element 10 is removably attached to the bit body 6. The latching section 14 of the closure element 10 comprises a substantially cylindrical outer sleeve 23 which extends with narrow clearance along the bore 20. A sealing ring 24 is arranged in a groove around the circumference of the outer sleeve 23, to prevent fluid communication along the outer surface of the latching section 14. Connected to the lower end of the sleeve 23 is the insert section 12. The latching section 14 further comprises an inner sleeve 25 which slidingly fits into the outer sleeve 23. The inner sleeve 25 is biased with its upper end 26 against an inward shoulder 28 formed by an inward rim 29 near the upper end of the sleeve 23. The biasing force is exerted by a partly compressed helical spring 30, which pushes the inner sleeve 25 away from the insert section 12. At its lower end the inner sleeve 25 is provided with an annular recess 32 which is arranged to embrace the upper part of spring 30.

The outer sleeve 23 is provided with recesses 34 wherein locking balls 35 are arranged. A locking ball 35 has a larger diameter than the thickness of the wall of the sleeve 23, and each recess 34 is arranged to hold the respective ball 35 loosely so that it can move a limited distance radially in and out of the sleeve 23. Two locking balls 35 are shown in the drawing, however it will be clear that more locking balls can be arranged.

In the closing position as shown in FIG. 1 the locking balls 35 are pushed radially outwardly by the inner sleeve 25, and register with the annular recess 36 arranged in the bit body 6 around the bore 20. In this way the closure element 10 is locked to the drilling bit 1. The inner sleeve 25 is further provided with an annular recess 37, which is, in the closing position, longitudinally displaced with respect to the recess 36 in the direction of the drill string 3.

The inward rim 29 is arranged to cooperate with a connection means 39 at the lower end of a fluid injection tool 40, which connection means 39 serves as a means for removing the closure element from the closing position. Only the lower part of the fluid injection tool 40 is shown. The connection means 39 is provided with a number of legs 50 extending longitudinally downwardly from the circumference of the fluid injection tool 40. For the sake of clarity only two legs 50 are shown, but it will be clear that more legs can be arranged. Each leg 50 at its lower end is provided with a dog 51, such that the outer diameter defined by the dogs 51 at position 52 exceeds the outer diameter defined by the legs 50 at position 54, and also exceeds the inner diameter of the rim 29. Further, the inner diameter of the rim 29 is preferably larger or about equal to the outer diameter defined by the legs 50 at position 54, and the inner diameter of the outer sleeve 23 is smaller or approximately equal to the outer diameter defined by the dogs 51 at position 52. Further, the legs 50 are arranged so that they are inwardly elastically deformable as indicated by the arrows. The outer, lower edges 56 of the dogs 51 and the upper inner circumference 57 of the rim 29 are bevelled. It shall be clear that the lower end of the fluid injection tool 40 including the connection means 39 can form a separate auxiliary tool for removing the closure element. The auxiliary tool can be so arranged that it can be releasably mounted on the fluid injection tool.

The drill bit 1 with the closure element 10 in the closing position as shown in FIG. 1 has the shape and full functionality of a conventional PDC drill bit and can thus be used for normal drilling operation in the same way as well known in the art.

When it is desired to introduce fluid into the borehole 2 below the drill bit 1, the drill bit is first positioned a distance above the bottom of the borehole. Then, the closure element 10 can be outwardly removed from the closing position in the drill bit 1.

To this end, the fluid injection tool 40 is lowered from a position inside the drill string 3 along the passageway 8 in the bit body 6, until the connection means 39 engages the upper end of upper end of the latching section 14 of the closure element 10. The dogs 51 slide into the upper rim 29 of the outer sleeve 23. The legs 50 are deformed inwardly so that the dogs can slide fully into the upper rim 29 until they engage the upper end 26 of the inner sleeve 25. By further pushing down, the inner sleeve 25 will be forced to slide down inside the outer sleeve 23, further compressing the spring 30. When the space between the upper end 26 of the inner sleeve 25 and the shoulder 28 has become large enough to let in the dogs 51, the legs 50 snap outwardly, thereby latching the fluid injection tool to the closure element.

At approximately the same relative position between inner and outer sleeves, where the legs snap outwardly, the recesses 37 register with the balls 35, thereby unlatching the closure element 10 from the bit body 6. At further pushing down of the fluid injection tool the closure element is integrally pushed out of the bore 20.

When the closure element has been fully pushed out of the bore 20, the diameter of the fluid injection tool 40 determines if fluid communication through an annular orifice between the outer diameter of the auxiliary tool 40 and the bore 20 is possible. Suitably, the fluid injection tool is so arranged that no such orifice is present or that fluid communication through the orifice is blocked.

The injection of fluid into the borehole through the fluid injection tool will be described in more detail with reference to FIGS. 2 and 3. The connection means 39 co-operates with the latching mechanism of the closure element, so that the closure element 10 remains connected to the fluid injection tool 40 after having been removed from the closing position. This allows, when it is so desired after the injection of fluid, that the closure element 10 can easily be returned to the closing position. This can be done by retracting the fluid injection tool 40 until the locking balls 35 of the closure element latch again into the annular recess 36 of the bit body 6, whereupon the connection means 39 can be disconnected from the closure element 10. It will be understood, that in certain applications retraction may not be required, for example when it is not desired to continue drilling after fluid injection. It is therefore possible that the lower end of the fluid injection tool simply pushes the closure element out or otherwise removes the closure element from the closing position, without connecting itself to the closure element.

Figure 2:
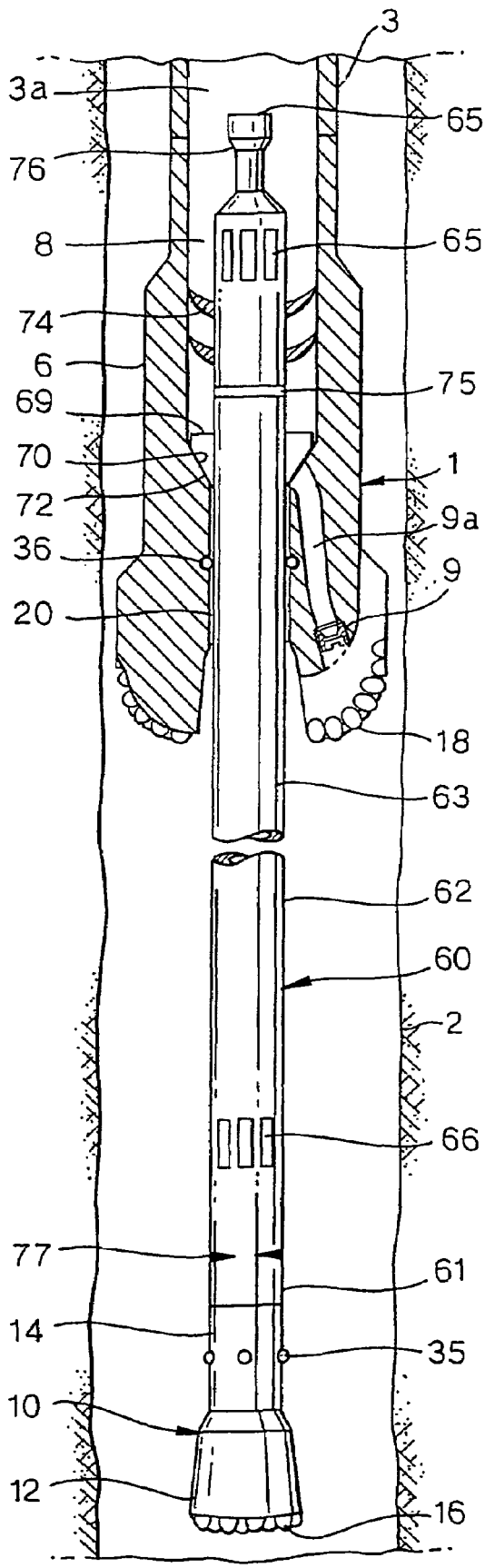
FIG. 2 shows schematically an embodiment of the invention.

Reference is now made to FIG. 2, which shows schematically an embodiment of the invention that is particularly suitable for introducing cement into the borehole. The embodiment is based on the drill bit discussed with reference to FIG. 1, and like reference numerals as in FIG. 1 are used to refer to similar objects. The fluid injection tool of this embodiment is a cementing tool 60.

The drill bit 1 connected to the lower end of the drill string 3 is shown in the borehole 2. As shown in FIG. 2, the closure element 10 has been outwardly removed from the closing position by the cementing tool 60 as discussed with reference to FIG. 1. The connection means is also arranged so as to prevent fluid communication from the interior of the conduit 63 to nozzles in the insert section 14.

The cementing tool 60 further includes a cementing stinger 62. The stinger 62 comprises a substantially cylindrical conduit 63 of about 50 m length, wherein tool inlets 65 and tool outlets 66 are arranged near the upper and lower ends, respectively. The tool outlets have the form of slits arranged around the circumference of the conduit 63. One tool inlet is arranged at the top of the fluid injection tool so that it can receive a ball or plug from the drill string, other inlets can also be arranged as slits.

The cementing tool 60 further comprises a landing member 69 which is annularly fitted around the conduit 63, between the tool inlet 65 and the tool outlet 66. The landing member has a landing surface 70, which cooperates with a landing seat 72 of the drill bit, so that the passage of fluid along the channel 9*a* to the nozzle 9 is blocked when the landing member 69 rests on the landing seat 72.

In the landing position as shown in FIG. 2 the tool inlet 65 resides in the passageway 6, and the tool outlet 66 has passed through the drill bit and resides in the borehole ahead of the bit.

A number of swab cups 74 are fitted around the circumference of the conduit 63, and prevent fluid flow in the annulus between the conduit 63 and the wall of the passageway past the position of the tool inlet 65. Further, the fluid injection tool 60 is provided with a rupture disc or shear disc 75 which closes off the conduit 63 as long as it is not destroyed, with a fishing neck 76 to which a wireline to the surface can be attached, and with a catcher or landing seat 77 which is arranged so as to catch balls or plugs that are received in the conduit 63, without blocking fluid communication between tool inlet 65 and tool outlet 66.

The drill bit 1 can for example have an outer diameter of 21.6 cm (8.5 inch), with a passageway of 6.4 cm (2.5 inch). The conduit 63 of the fluid injection tool in this case can have an outer diameter of 5.1 cm (2 inch).

During normal operation, the drill bit 1 with the closure element 10 in the closing position can be used for drilling in the borehole 2. During drilling, drilling fluid is circulated down the drill string, through the bit nozzles 9 into the borehole 2, and up to the surface, carrying drill cuttings to the surface. It is assumed that the fluid injection tool is located at the surface in the course of drilling, but it will be clear that the tool can also be stored in the drill string above the drill bit.

We will now consider the situation that a significant loss of drilling fluid is noticed, which loss is caused by drilling into a fractured/porous formation layer. It is desired to cure the losses by blocking fluid flow into the fractured formation by means of cement.

Then, rotation of the drill bit is stopped, and if necessary a short section of the drill string is retrieved, to allow sufficient space in the borehole ahead of the bit. The cementing tool 60 is deployed by pumping down or lowered through the drill string 3 by wireline attached to the fishing neck 76. The connection means at the lower end 61 connects to the latching section 14 of the closure element 10 and unlatches the closure element from the bit body 6. The closure element 10 is fully removed from the closing position by further pushing or pumping the fluid injection tool down, until the landing member 69 lands on the landing seat 72, where it blanks off the openings to the channels 9*a*.

Then the rupture disc 75 is destroyed for example by applying overpressure, and cement is circulated down in the interior of the drill string, preceded by a ball or plug if desired. The bottom of the cement reaches the drill bit 1, flows in the passageway 8, where it is received by the tool inlets 65, and then passes through the bit and further in the conduit 63, until it reaches the tool outlets 66. There it is introduced into the borehole. The ball or plug is caught in the catcher 77. The blow-out-preventer of the well may be shut to enable the cement to be squeezed into the formation. When the top of the cement in the annulus between the conduit 63 and the borehole wall about reaches the level of the face of the bit body 6, or earlier, pumping of the cement is stopped. The drill string 3 including drill bit 1 and cementing tool 60 are raised sufficiently to ensure that the insert section is above the cement. The drill string and fluid injection tool are cleaned by circulating drilling fluid, while the cement is setting. The hardening of the cement can be tested by setting down the fluid injection tool on the cement plug.

When the cement has hardened sufficiently, the fluid injection tool can be retracted to re-latch the closure element 10 into the closing position. Then, the cement can be drilled out. If fluid losses are cured, the fluid injection tool can be retracted to surface, and drilling can be continued. It shall be clear that the drill bit for use in such a cementing application should preferably be provided with a closure element that has a significantly smaller diameter than the borehole. In that case the cementing tool can also easily be retracted without disturbing the cement setting. In comparison with conventional cementing, the drill string does not have to be pulled out of the borehole for the entire operation of curing losses, and it is also not necessary to first stabilize the borehole by lost circulation material.

The fluid injection tool can further be provided with a means for treating the cement before introducing it into the borehole, so as to influence the hardening process. It is known in the art that additives to the cement can be used to trigger a reaction under downhole well conditions which initiates the hardening. The fluid injection tool can include a storage tank for additives, which is arranged so that additives are mixed to the cement received from the drill string before the mixture is introduced into the borehole. It is also possible that additives are already contained in encapsulated form in the cement received through the drill pipe. In this case, the fluid injection tool can include a shearing device which breaks up the encapsulated additives so that they can react with the cement.

It will be clear, that instead of drilling the cement plug out, the borehole section below the plug can also be abandoned. In the latter case, drilling can be continued in a deviating direction, or the entire drill string can be retrieved to surface.

An embodiment suitable for introducing lost circulation material ahead of the drill bit looks basically similar to the embodiment schematically shown in FIG. 2, wherein the main difference is that the stinger 62 is typically shorter, for example 10-20 m.

In another application of an embodiment as shown in FIG. 2, the fluid injection tool can be pre-loaded at the surface with fluid, wherein the tool outlet is closed. After lowering the tool to the landing position, the tool outlet is opened and fluid is pushed or pumped into the borehole. The fluid can for example consist of two separate components, which form a polymer or elastomer after they have been mixed. If the mixing is done shortly before the mixture is introduced in the borehole, a polymer plug can be arranged in the borehole, for example a polyurethane plug.

In yet another application a cement plug is set in the borehole by contacting two cement-forming fluid components only in the borehole outside of the drill string, wherein the first fluid component is introduced into the borehole through the fluid injection tool as described hereinbefore, and wherein the second component is pumped down the annulus between borehole and drill string. This is particularly advantageous in a situation of acute losses of drilling fluid downhole. On the one hand there may be no time or too high a risk for pulling the drill string up; on the other hand the losses allow to pump fluid down both inside and outside the drill string without taking additional measures to prevent excessive pressure build-up. A further advantage is that one can achieve almost instantaneous setting of the cement after contacting of the two cement-forming components, without running the risk of solidifying prematurely in the drill string. In this way the operational risk and time needed for cementing is further reduced.

Two-component cement systems are well known in the art, see for example the book "Well Cementing" by B. E. Nelson, Elsevier Science, 1990, Schlumberger Educational Services, TSL-4135/ICN-015572000, section 6-11.3 (page 6.13) or the U.S. Pat. Nos. 5,447,197 and 5,547,506.

Suitably, a cement slurry is introduced as the first cement-forming component through the fluid injection tool, and contacted with an aqueous or oil-based second cement-forming component which triggers the slurry to set. An aqueous Portland cement slurry as first component and a diesel oil mixed with Bentonite as second component form upon contact a very viscous cementitious mass. It shall be clear that as two-component cement systems in this context are also regarded organic and inorganic two-component systems which have the ability to almost instantaneously form a solid mass when the two components come into contact, such as two component (epoxy) resins, polyesters, silicone rubbers, and calcium carbonate/sodium silicate.

Figure 3:
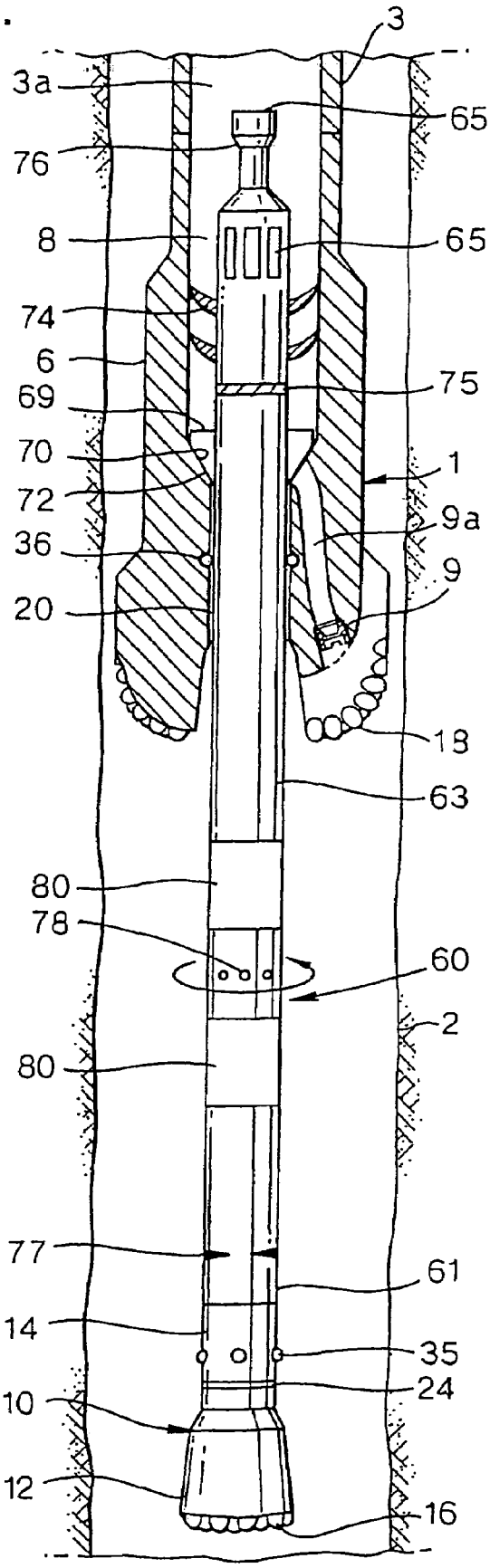
FIG. 3 shows schematically a further embodiment of the invention.

Reference is made to FIG. 3, which shows schematically a further embodiment of the present invention. This embodiment is suitable for cleaning of the borehole wall ahead of the drill bit. The embodiment of FIG. 3 is similar to the embodiment shown in FIG. 2, and like reference numerals as in FIGS. 1 and 2 are used to refer to similar objects. The main difference to the embodiment of FIG. 2 is that the fluid injection tool 40 does not comprise a cementing stinger, but rather a jet cleaning tool. The jet-cleaning tool 76 comprises one or more nozzles 78 radially arranged in the wall of the conduit 63, wherein the nozzles 78 are rotatably arranged in between two swivels 80, so that rotation is induced when fluid is injected into the borehole through the nozzles with pressure.

The jet cleaning tool can for example be used in conjunction with a drilling operation, in order to remove mudcake from the borehole wall, or to clean a section of a casing above a drilled open hole section where a liner hanger, packer or other isolating device is to be installed. Drilling is stopped, the jet cleaning tool is deployed through the drill string and pumped out, thereby unlatching and removing the closure element from the closing position similar to the unlatching of the closure element discussed with reference to FIGS. 1 and 2. Cleaning fluid is circulated down the drill string, into the passageway 8 of the drill bit 1, where it is received by the tool inlets 65 and guided ahead of the drill bit through the conduit 63. The fluid is introduced into the borehole via the nozzles 78 at high speed, thereby cleaning the borehole wall. Again, there is no need to pull the drill string out of the borehole for such a cleaning operation.

In a different embodiment of a jet cleaning tool (not shown) the nozzles can be arranged to eject fluid jets in other directions. This can for example be useful in a situation where the bit face has become clogged up (balled) with drill cuttings, so that normal drilling performance is seriously impaired.

A shorter version of the jet-cleaning tool, wherein the nozzles in the landing position point towards the bit face can be used to clean the bit face.

In the embodiments discussed with reference to FIGS. 1-3, the closure element has been removed from the closing position by fully detaching the closure element from the bit body. It will be clear, however, that the closure element can be removed from the closing position in other ways, for example by a pivoting mechanism where the closure element opens the passageway but remains connected to the drill bit.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

We claim:

1. A method for introducing a fluid into a borehole formed in an underground earth formation, in which borehole there is arranged a tubular drill string including a drill bit at its lower end, wherein the drill bit is provided with a passageway between the interior of the drill string above the drill bit and the borehole exterior of the drill bit, and with a removable closure element for selectively closing the passageway in a closing position, and wherein there is further provided a fluid injection tool comprising a tool inlet, and a tool outlet in fluid communication with the tool inlet, which method comprises the steps of:

passing the fluid injection tool from a position interior of the drill string to the closure element, and using the fluid injection tool to remove the closure element from the closing position;

passing the fluid injection tool to a landing position where the tool outlet has passed through the passageway and where the tool inlet resides inside the drill string in fluid communication with the interior of the drill string; and introducing the fluid from the interior of the drill string into the borehole, wherein the fluid is received by the tool inlet and introduced into the borehole through the tool outlet.

2. The method according to claim 1, wherein the fluid injection tool is provided with connection means for selectively connecting to the closure element, and wherein the step of removing the closure element from the closing position comprises connecting the fluid injection tool to the closure element.

3. The method according to claim 1, wherein the fluid is cement.

4. The method according to claim 3, wherein the method further comprises the steps of:

stopping the pumping of cement into the borehole;

waiting for the cement to harden;

retrieving of the fluid injection tool through the passageway so that the fluid injection tool is fully contained in the drill string;

moving the closure element into the closing position; and drilling, using the drill bit.

5. The method according to claim 1, wherein the fluid is a first cement-forming component, and wherein the method further comprises passing a second cement-forming component down along the annulus between the drill string and the borehole, so as to form cement after the first and second cement-forming components have come into contact with each other in the borehole.

6. The method according to claim 1, wherein the fluid is lost circulation material.

7. The method according to claim 1, wherein the fluid is a cleaning fluid.

8. The method according to claim 1, wherein the method further comprises the steps of:

stopping the injection of fluid into the borehole;

retrieving the fluid injection tool through the passageway so that the fluid injection tool is fully contained in the drill string;

moving the closure element into the closing position; and drilling, using the drill bit.

9. A system for drilling and for introducing a fluid into a borehole in an underground earth formation, the system comprising:

a tubular drill string having a drill bit at its lower end, wherein the drill bit is provided with a passageway between the interior of the drill string above the drill bit and the borehole exterior of the drill bit, and with a removable closure element for selectively closing the passageway in a closing position; and a fluid injection tool comprising a tool inlet and a tool outlet in fluid communication with the tool inlet, which fluid injection tool is arranged so that it can pass from a position interior of the drill string to a landing position where the tool outlet has passed through the passageway and where the tool inlet resides inside the drill string in fluid communication with the interior of the drill string, and wherein the fluid injection tool is provided with means for removing the closure element from the closing position.

10. The system according to claim 9, wherein the means for removing the closure element from the closing position comprises a connection means for selectively connecting the fluid injection tool from inside the drill string to the closure element in the closing position.

11. The system according to claim 9, wherein the drill bit further comprises a bit nozzle, and wherein the fluid injection tool comprises a landing member, which is arranged so as to close off fluid passage through the bit nozzle when the fluid injection tool is in the landing position.

12. The system according to claim 9, wherein the fluid injection tool comprises a cementing stinger.

13. The system according to claim 12, wherein the cementing stinger comprises means for treating the cement before introducing it into the borehole, so as to influence the cement hardening process.

14. The system according to claim 9, wherein the fluid injection tool comprises a jet cleaning tool.

15. The system according to claim 9, wherein the fluid injection tool comprises a telescopic conduit between tool inlet and tool outlet.

16. The system according to claim 9, wherein the passageway has a minimum cross-sectional area of at least 5 $cm^2$.

17. The system according claim 9, wherein the closure element is provided with cutting elements that form a joint bit face with other cutting elements on the bit face when the closure element is in the closing position.

18. The system according to claim 9, wherein the drill bit with the closure element in the closing position has substantially the shape of a conventional PDC drill bit or of a conventional roller cone drill bit.

19. The system according to claim 9, wherein the connection means of the fluid injection tool is arranged such that it can be disconnected from the closure element when the closure element has resumed the closing position after retracting the fluid injection tool from the borehole into the drill string.

* * * * *